US007000581B1

(12) United States Patent
Mavinahally et al.

(10) Patent No.: US 7,000,581 B1
(45) Date of Patent: Feb. 21, 2006

(54) MONO-SHAFT FOUR-STROKE ENGINE

(75) Inventors: Nagesh Siddabasappa Mavinahally, Granada Hills, CA (US); Jay S. Veerathappa, Northridge, CA (US)

(73) Assignee: Nagesh S. Mavinahally, Anderson, SC (US)

( * ) Notice: Subject to any disclaimer, the term of this patent is extended or adjusted under 35 U.S.C. 154(b) by 40 days.

(21) Appl. No.: 10/659,656

(22) Filed: Sep. 10, 2003

Related U.S. Application Data

(60) Provisional application No. 60/409,474, filed on Sep. 10, 2002.

(51) Int. Cl.
*F01L 1/30* (2006.01)

(52) U.S. Cl. ..... 123/90.24; 123/90.15; 123/90.2; 123/90.6

(58) Field of Classification Search ..... 123/90.12, 123/90.24, 90.15, 90.2, 90.6
See application file for complete search history.

(56) References Cited

U.S. PATENT DOCUMENTS 1,248,597 A 12/1917 Baker
4,736,717 A * 4/1988 Fujikawa et al. ..... 123/90.2
4,748,945 A * 6/1988 Fujikawa et al. ..... 123/90.2
4,762,094 A 8/1988 Fujikaw et al.
4,762,098 A 8/1988 Tamba et al.
4,844,022 A * 7/1989 Konno ..... 123/90.16
5,347,967 A 9/1994 Todero et al.
5,582,145 A * 12/1996 Aizawa et al. ..... 123/196 CP

OTHER PUBLICATIONS

Naoki Okanishi et al. 'Torque boosting of 4-stroke Cycle Spark-Ignition Engines by Crankcase-Supercharging', SAE Technical paper No. 900173, 1990.

* cited by examiner

*Primary Examiner*—Thomas Denion
*Assistant Examiner*—Zelalem Eshete
(74) *Attorney, Agent, or Firm*—Steven J. Rosen

(57) ABSTRACT

A 4-stroke engine incorporating a mono-shaft multi-valve operating system, the multi-valve operating system incorporating a first cam follower assembly that is associated with an intake valve, a second cam follower assembly that is associated with an exhaust valve, and a cam follower channel assembly that is integrated into a crank web of the engine, the cam follower channel assembly including a base circle channel, a cam channel, and a cross-over channel. The cam follower channel assembly is configured to commonly interact with the two cam follower assemblies to operate the intake valve at a first instance, and the exhaust valve at a second instance, with both instances occurring while the crank web completes two rotations. When either of the two cam follower assemblies engages with a cam channel of the cam follower channel assembly, the cam follower channel assembly is configured to provide a camming operation to operate the respective valve. When either of the two cam follower engages a base circle channel of the cam follower channel assembly, the cam follower channel assembly is configured to prevent operation of the respective valve.

26 Claims, 8 Drawing Sheets

1 Exhaust valve lift
2 Intake valve lift - conventional
3 Intake valve lift - extended expansion
4 Expansion
5 Exhaust
6 Intake
7 Compression

MONO-SHAFT FOUR-STROKE ENGINE

CROSS-REFERENCE TO RELATED APPLICATIONS

This application claims the benefit of U.S. Provisional Patent Application Ser. No. 60/409,474 filed on Sep. 10, 2002, and entitled "Multi-purpose mono-shaft four-stroke engines" which is hereby incorporated by reference in its entirety.

FIELD OF THE INVENTION

The present invention generally relates to internal combustion engines, and particularly to four-stroke engines.

BACKGROUND AND PRIOR ART

A conventional four-stroke engine incorporates a large number of moving parts, which add to the engine's cost, weight, and complexity, while negatively impacting its reliability, serviceability, and longevity. Some parts that are associated with the valve train of a four-stroke engine are intake and exhaust valves of an engine include camshaft, camlobes, rockers, push tubes, rocker pins, reduction gears, and camshaft bearings. The intake and exhaust valves are each operated once every two rotations of the crankshaft, causing the camlobes mounted on camshaft to be rotated at half the engine-speed. This arrangement necessitates the use of a 1:2 reduction gear and a gear-train, thereby increasing the weight and parasitic losses of the engine. An increase in weight of any of the parts that constitute an engine, leads to a reduction in the engine's overall power-to-weight ratio.

Maximizing this power-to-weight ratio is very desirable in any engine design/construction. One method of improving this power-to-weight ratio may be carried out by reducing the weight of an existing part by the elimination of redundant parts by using alternative design approaches—for example. A second approach involves increasing the breathing efficiency of the engine by supercharging the engine using piston and crankcase as a pump. The combination of the first and second approaches becomes even more attractive when the replaced parts are moving parts, because a reduction in moving parts contributes to improved reliability of the engine.

As is known, when one moving part acts against another part, moving or stationary, friction is created thereby leading to generation of heat. Lubricating systems are typically used to reduce this heat. Lubricating systems related to four-stroke engines utilize oil as a lubricant. This oil is often stored in an oil reservoir from where it is drawn by a circulation system utilizing various mechanisms such as pumps, slingers, misters, and auxiliary reservoirs, to circulate the oil over the heat-generating moving parts. Some lubricating systems, such as those employed in engines for hand-held devices, place restrictions on the allowable orientation of this oil reservoir.

For example, certain trimmers cannot be operated upside down, because such an orientation causes the oil in the reservoir to be located at the wrong end of the reservoir where the pumping system cannot draw it out, or at the wrong end of the chamber where it cannot effectively lubricate the moving parts. While this orientation-issue has been addressed by a variety of solutions, some of the solutions have involved the use of complicated mechanisms incorporating a significant number of additional parts that add to the weight and complexity of the engine.

Besides the desirability of reducing the number of moving parts in an engine, and consequently reducing its lubricating requirements, it is also desirable that a lubricating system used in such an engine incorporates the least number of parts to perform its lubricating function while additionally permitting the engine to be operated in multiple orientations with good thermal efficiency. The thermal efficiency of an internal combustion engine is proportional to its expansion ratio. In a traditional engine this expansion ratio is typically equal to its compression ratio, thereby causing its thermal efficiency to be proportional to the compression ratio. Control of the compression ratio is limited by the characteristic of the fuel used in the engine, as the fuel determines when engine-knock occurs. This limitation may be overcome to some degree by operating the engine with a compression ratio that is lower than its expansion ratio. This operation can be generally carried out by adjusting the valve timing with reference to the piston's bottom-dead-center (BDC) either by closing the valve early before the piston reaches BDC during an intake stroke, or late after the piston passes BDC during a compression stroke. While this type of timing adjustment contributes to lowering the effective compression ratio, which may be described as a ratio of cylinder volume at BDC to the cylinder volume at intake valve closing, it also causes the effective displacement volume of the engine to be reduced thereby leading to an undesirable lowering of power density (power/cc of displacement), especially in naturally-aspirated engines. One solution to resolving the issue of reduced effective displacement volume involves turbo-charging. Unfortunately traditional turbo-charging techniques are expensive, and involve a number of additional engine parts.

Given the limitations of traditional internal combustion engines as described above, it is desirable to provide solutions that address such issues as improving the thermal efficiency, improving reliability, and reducing the number of parts, stationary or otherwise, that are used in the construction of internal combustion engines.

SUMMARY OF THE INVENTION

A 4-stroke internal combustion engine that incorporates a mono-shaft multi-valve operating system, the system including a first cam follower assembly configured to operate an intake valve of the engine, a second cam follower assembly configured to operate an exhaust valve of the engine, and a cam follower channel assembly. The cam follower assembly has a base circle channel circumferentially cut into a crank web of the engine, a cam channel that is cut substantially parallel to the base circle channel, a channel crossover cut to provide channel interconnectivity between the base circle channel and the cam channel. When the first cam follower assembly is slideably engaged to the cam channel the exhaust valve is operated during a first-half rotation of the crank web, and when the second cam follower assembly is slideably engaged to the cam channel the intake valve is operated during a second-half rotation of the crank web.

In a second embodiment of the invention, a 4-stroke internal combustion engine incorporates a mono-shaft multi-valve operating system, the system including a first cam follower assembly configured to operate an intake valve of the engine, a second cam follower assembly configured to operate an exhaust valve of the engine, a fuel injection system incorporating a fuel-injection follower assembly, and a single cam follower channel assembly operatively interconnected to the first and second cam follower assemblies as well as the fuel injection follower assembly.

In a third embodiment of the invention, a 4-stroke internal combustion engine incorporates a mono-shaft multi-valve operating system, the system including a first cam follower assembly configured to operate an intake valve of the engine, a second cam follower assembly configured to operate an exhaust valve of the engine, and a dual cam follower channel assembly operatively interconnected to the first and second cam follower assemblies. The third embodiment differs from the first embodiment in that the cam follower channel assembly is comprised of two unique cam channels. Each cam channel is comprised of a unique cam profile with a common base circle diameter interchange profile providing for disparate amounts of intake or exhaust valve opening and closure, thus referred to as asymmetric timing.

Asymmetric timing using the specified dual cam follower channel assemblies require cam follower assembly equipped for "lost motion". Lost motion is defined as the absence of cam follower assembly valve lifting action normally caused by an intake or exhaust cam follower traveling on a cam. For example, when the intake cam follower by design tracks to the exhaust cam channel, the follower arm will be positioned over a follower arm spring. This spring, which has less spring force than its respective intake valve spring, gives way. This allows the cam follower to track cam channel profile without allowing the follower assembly to transmit lift to the valve, and thus the lost motion.

DESCRIPTION OF THE DRAWINGS

Many aspects of the invention can be better understood with reference to the following drawings. The components in the drawings are not necessarily drawn to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

Figure 1:
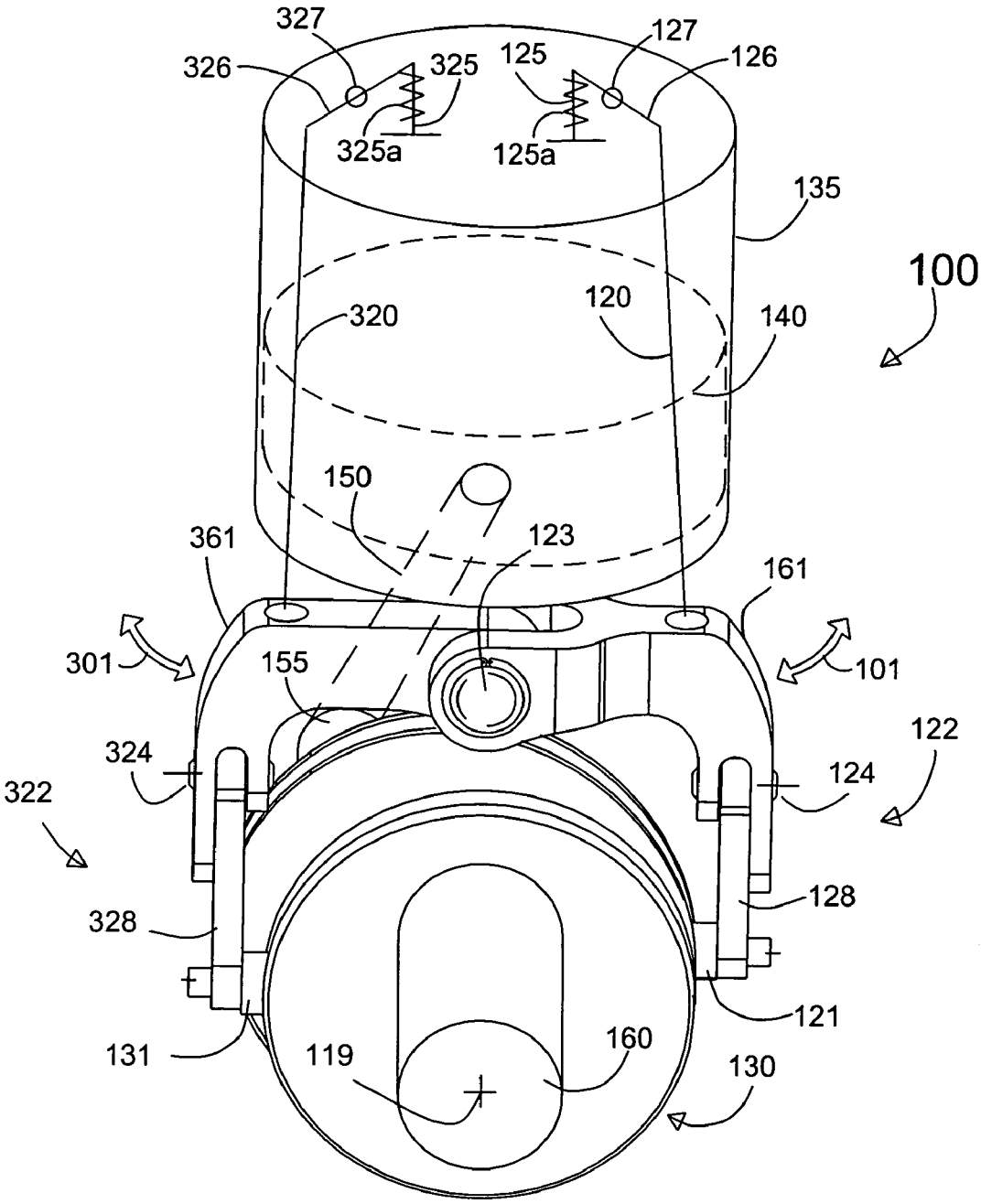
FIG. 1 is a perspective view of a first embodiment of an engine incorporating a mono-shaft engine valve operating system.

While the description below refers to certain exemplary embodiments, it is to be understood that the invention is not limited to these particular embodiments. On the contrary, the intent is to cover all alternatives, modifications and equivalents included within the spirit and scope of the invention as defined by the appended claims. Also, the terminology used herein is for the purpose of description and not of limitation.

Attention is drawn in general to FIGS. 1–4*a*, which illustrate various views of one exemplary embodiment of an engine incorporating a mono-shaft engine valve operating system.

Four-stroke engine 100 generally comprises a cylinder block 135 that includes a cylinder bore 145. A piston 140 reciprocates within the cylinder bore 145 and is connected by means of a connecting rod 150 to a crank pin 155 associated with crank web 130. The reciprocating motion of piston 140 is translated into a rotary motion of crankshaft 160 that is journaled for rotation within a crankcase chamber 161 of a crankcase 165 that is affixed to the lower end of cylinder block 135 in a suitable manner.

A combustion chamber 166 is defined by a region within the cylinder block 135 above the piston 140. Intake valve 125 is an engine valve that operates to allow a fuel-air mixture into the combustion chamber 166 at suitable intervals of the four-stroke cycle. Exhaust valve 325, a second engine valve of engine 100, operates to allow exhaust gases to exit combustion chamber 166 at suitable intervals of the four-stroke cycle.

In this exemplary embodiment, the mono-shaft engine valve operating system can be defined as a mono-shaft engine multi-valve operating system. Multi-valve operating system incorporates a first cam follower assembly 122 that is associated with intake valve 125, a second cam follower assembly 322 that is associated with exhaust valve 325, and a cam follower channel assembly 180 that is integrated into crank web 130 of engine 100, the cam follower channel assembly 180 including a base circle channel 105, a cam channel 110, and a cross-over channel 111.

Cam follower assembly 122 that is associated with intake valve 125, will now be described in further detail. Intake valve 125 is connected to one end of a pivoting linkage arm 126 that pivots on pivot pin 127 that is mounted on the top surface of engine block 135. The other end of pivoting linkage arm 126 is attached to a top end of push tube 120. This configuration permits a vertical downward-upward movement of push tube 120, which occurs during a 4-stroke engine cycle, to operate intake valve 125 in a correspondingly upward-downward vertical movement. The vertical movement of intake valve 125 defines two valve positions wherein a valve "closed" condition exists when valve 125 reaches a vertically maximal height, and a valve "open" condition exists when valve 125 is at a vertically minimal height.

Cam follower assembly 122 may be generally defined as comprising an L-shaped follower arm 161 that is secured at one end of the L-shape to a free-standing pivot pin 123, and wherein the other end of the L-shape of follower arm 161 is attached to a transverse follower arm 128 that is in slideable contact with crank web 130. The slideable contact of transverse follower arm 128, which provides the pivoting action for L-shaped follower arm 161, will be explained in further detail later. The bottom end of push tube 120 is connected to the vertex of the L-shaped follower arm 161. With this configuration, push tube 120 is urged to reciprocate up and down whenever follower arm 161 pivots on pivot pin 123. The pivoting action of follower arm 161 is in correspondence to a rotation of the cam follower channel assembly 180 that provides a camming function. This camming function will be described later. Pivoting direction of follower arm 161 is generally described by arrow 101 of FIG. 1.

Also attached to pivot pin 123 is a second follower arm 361 that is a part of cam follower assembly 322 connected to push tube 320 that is associated with exhaust valve 325. Cam follower assembly 322 will be now described in further detail. Exhaust valve 325 is connected to one end of a pivoting linkage arm 326 that pivots on pivot pin 327 that is mounted on the top surface of engine block 135. The other end of pivoting linkage arm 326 is attached to a top end of push tube 320. This configuration permits a vertical downward-upward movement of push tube 320, which occurs during a 4-stroke engine cycle, to operate exhaust valve 325 in a correspondingly upward-downward vertical movement. The vertical movement of exhaust valve 325 defines two valve positions wherein a valve "closed" condition exists when valve 325 reaches a vertically maximal height, and a valve "open" condition exists when valve 325 is at a vertically minimal height.

Cam follower assembly 322 may be generally defined as comprising an L-shaped follower arm 361 that is secured at one end of the L-shape to the free-standing pivot pin 123, and wherein the other end of the L-shape of follower arm 361 is attached to a transverse follower arm 328 that is in slideable contact with crank web 130. The slideable contact of transverse follower arm 328, which provides the pivoting action for L-shaped follower arm 361, will be explained in further detail later. The bottom end of push tube 320 is connected to the vertex of the L-shaped follower arm 361. With this configuration, push tube 320 is urged to reciprocate up and down whenever follower arm 361 pivots on pivot pin 123. The pivoting action of follower arm 361 is in correspondence to a rotation of the cam follower channel assembly 180 that provides a camming function. This camming function will be described later. Pivoting direction of follower arm 361 is generally described by arrow 301 of FIG. 1.

The slideable contact of transverse follower arm 128 of cam follower assembly 122, with crank web 130 will now be explained using FIGS. 1–4*a*. It will be understood that the configuration and description of operation of cam follower assembly 122 that is associated with intake valve 125, is correspondingly applicable to the configuration and description of operation of cam follower assembly 322 that is associated with exhaust valve 325.

In this exemplary embodiment, transverse follower arms 128 and 328 are in slideable contact with a single, commonly-shared cam follower channel assembly 180 that is incorporated into crank web 130. In other embodiments, a multiplicity of cam follower channel assemblies may be incorporated directly on a single, commonly-shared crank web, or, alternatively, one or more channel assemblies that are incorporated into one or more disks that are rotatably attached to a common crankshaft, may also be used.

Figure 2:
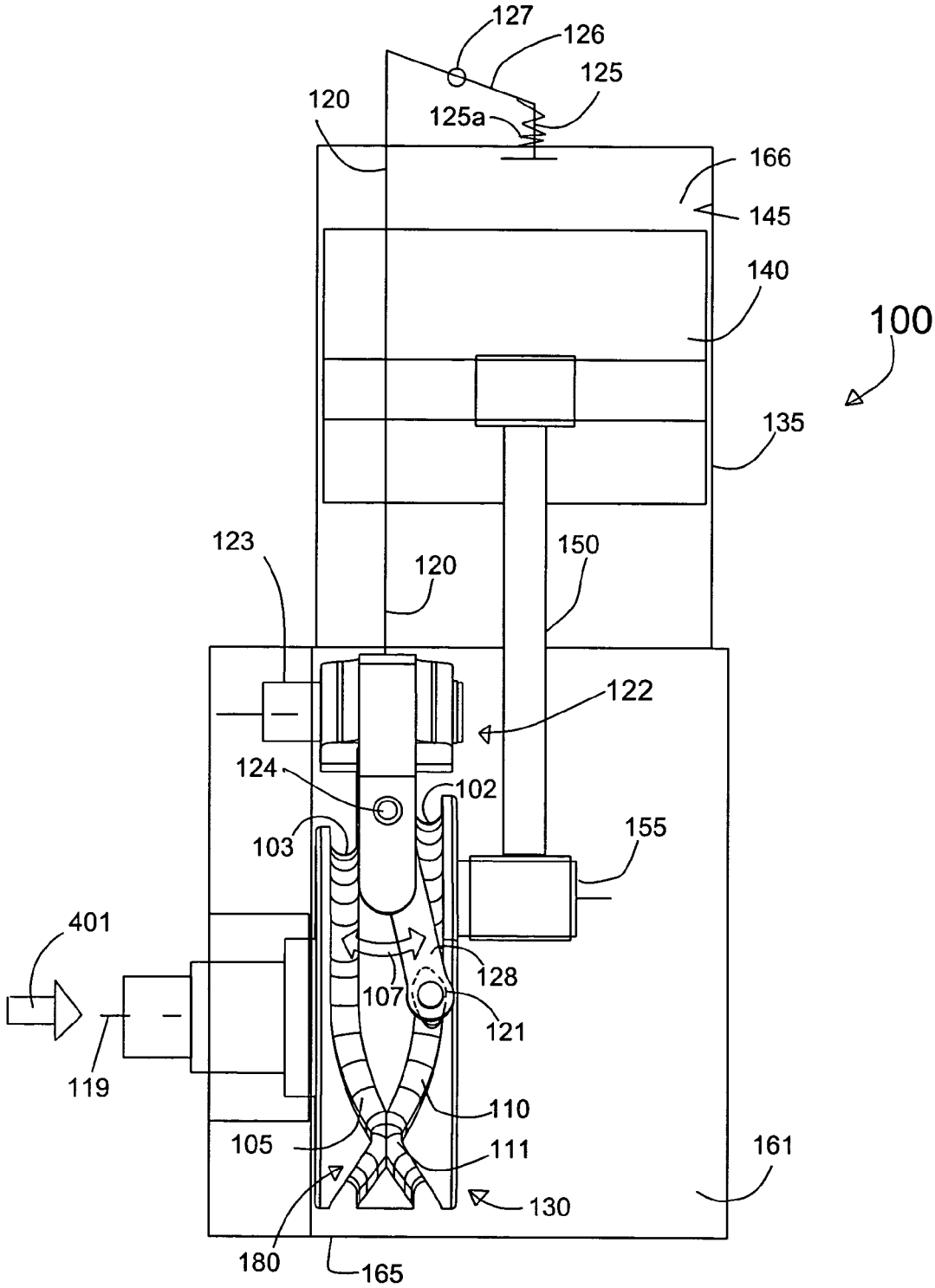
FIG. 2 is an elevational view of the engine of FIG. 1 when viewed from the intake valve side, with a cam follower assembly disposed in a cam channel of a cam follower channel assembly, consequently configuring the intake valve to an open position.
Figure 3:
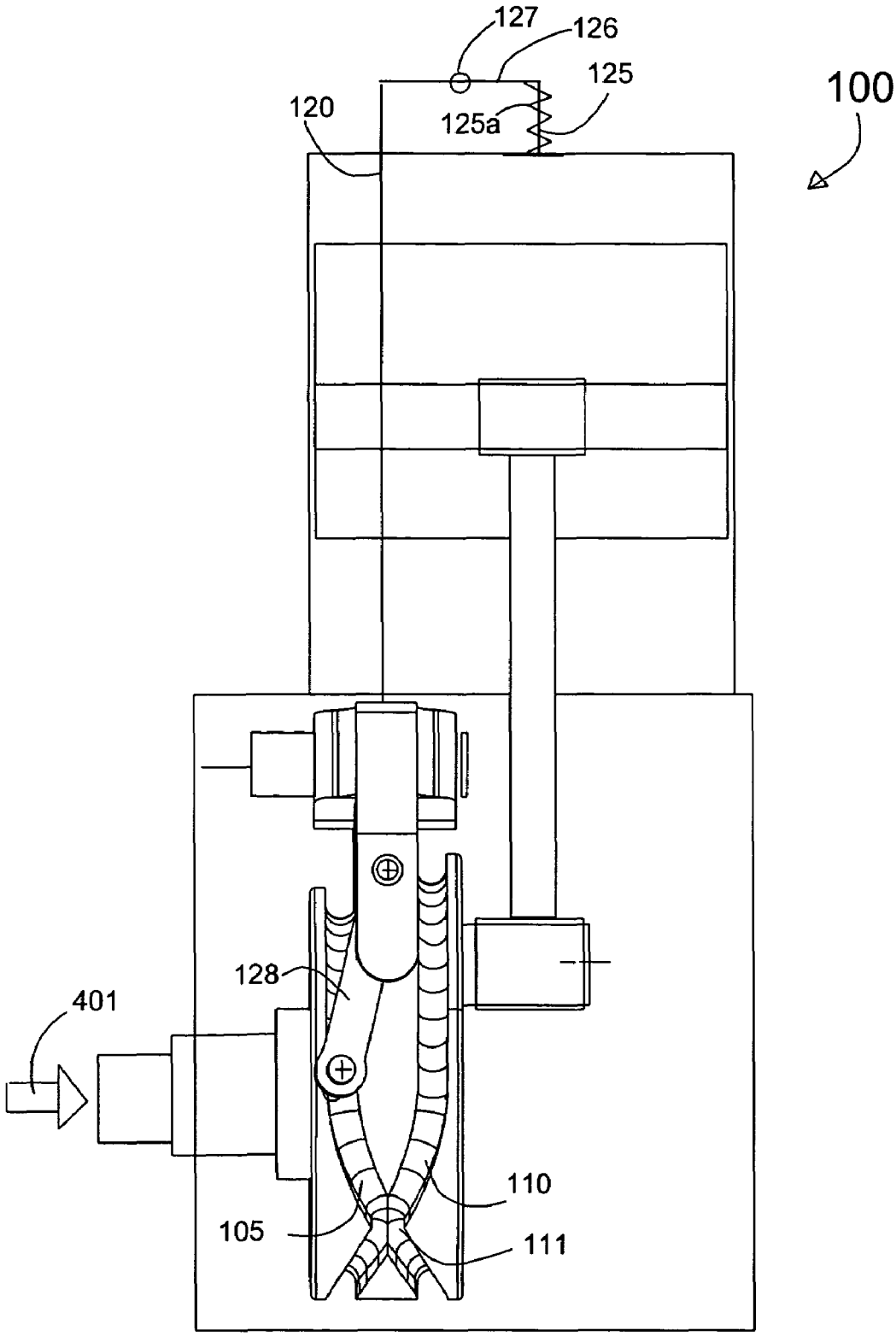
FIG. 3 is an elevational view of the engine of FIG. 1 when viewed from the intake valve side, with a cam follower assembly disposed in a base circle channel of the cam follower channel assembly, consequently configuring the intake valve to a closed position.

Drawing attention to FIGS. 1 and 2 that illustrate cam follower assembly 122 in greater detail, cam follower assembly 122 comprises L-shaped follower arm 161, transverse follower arm 128, pivot pin 124, and follower 121. Transverse follower arm 128 is pivotably attached to follower arm 161 through pivot pin 124, and is configured to describe a transverse movement that is generally described by arrow 107 of FIG. 2. Follower 121 is mounted on transverse follower arm 128 at a distal end away from the end of transverse follower arm 128 that is connected to pivot pin 124.

Follower 121 may comprise a cylinder element, an oval-shaped sliding element, a roller element, a ball element, a spring element, or any other element that provides slidable or rollable contact with channels 105 or 110 of cam follower channel assembly 180, such contact being provided at one or more points such as the sidewalls or bottom surface of either channel.

Follower 121 is slideably housed inside one of channels 105 or 110 of cam follower channel assembly 180 that is cut in crank web 130. This configuration permits follower 121 to slidingly track either channel thereby urging transverse follower arm 128 to pivot transversally when crank web 130 rotates during a 4-stroke cycle.

Follower 121 alternately slides in channels 105 and 110, and operates intake valve 125 once in every two rotations of crank web 130. This will be explained in greater detail later. The 2-cycle rotation of crank web 130 and corresponding one-time valve operation, conforms to conventional 4-cycle engine operating conditions wherein a conventional camshaft operates at half the engine rotational rate.

Figure 4:
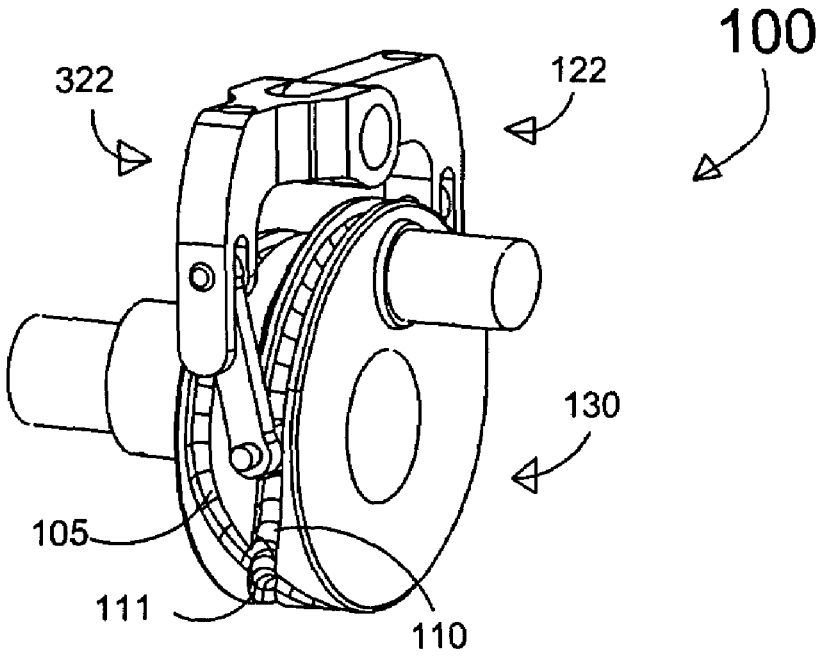
FIG. 4 is a second perspective elevational view the engine of FIG. 1.
Figure 4A:
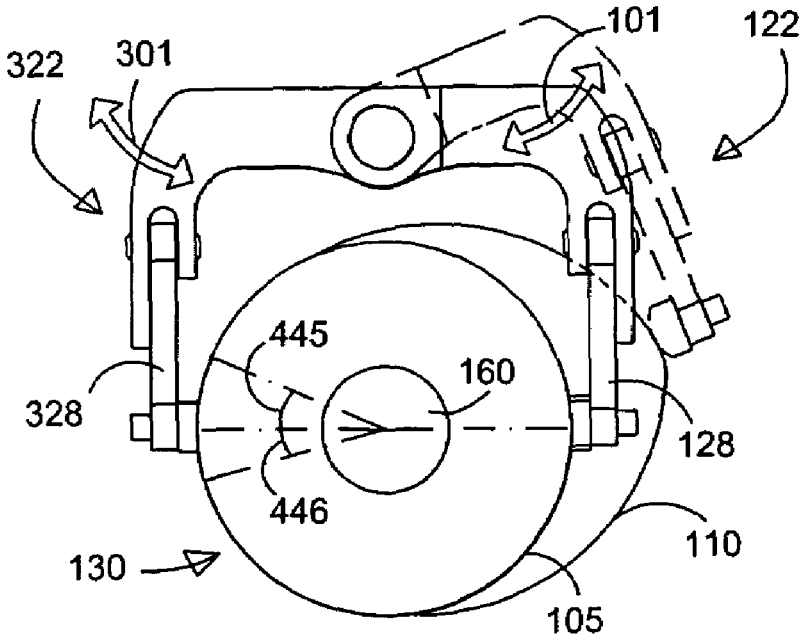
FIG. 4*a* is a profile view of the cam follower channel assembly to illustrate operation of a base circle channel and a cam channel in the mono-shaft engine valve operating system of FIGS. 1–4.

Attention is drawn to FIGS. 2–4*a* to describe cam follower channel assembly 180 that is circumferentially cut into crank web 180, and includes a base circle channel 105, a cam channel 110, and a cross-over channel 111. FIG. 4*a* illustrates a profile view of crank web 130 as viewed in the direction of arrow 401. Base circle channel 105 is a circular tracking guide mechanism that provides circumferential contact to follower 121 and maintains follower 121 in a constant circular radial distance with reference to crankshaft 160 during one rotation of crankshaft 160. During this rotation of crankshaft 160, L-shaped follower arm 161 maintains resilient inward pressure upon transverse follower arm 128 to place arm 128 in slideable contact with base circle channel 105. Push rod 120 that is connected to cam follower assembly 122 retains a downward elevational position thereby causing intake valve 125 to remain closed. At the end of this rotation, follower 121 is urged by cross-over channel 111 into the cam channel 110.

During a second rotation, cam channel 110 provides a camming action by applying radially outwards-extending pressure upon follower 121, and urging cam follower assembly 122 in the direction of arrow 101 shown in FIG. 4*a*. When cam follower assembly 122 is urged by this camming action, pushrod 120 is urged upwards and associated intake valve 125 is fully opened once when the follower 121 is located at the general apex of the cam.

Therefore, two rotations of the crankshaft 160 corresponds to an opening of the intake valve once. Drawing attention to FIG. 2, intake valve 125 remains closed when follower 121 is positioned on base circle channel 105 at circumferential location 103, and intake valve 125 is open when follower 121 is positioned on cam channel 110 at circumferential location 102.

While cam follower assembly 122 is engaged by cam follower channel assembly 180 to provide intake valve operation, cam follower channel assembly 180 also provides simultaneous exhaust valve operation by simultaneously engaging with cam follower assembly 322. Operation of the exhaust valve 325 is similar to that of the intake valve, and opening of the exhaust valve 325 also occurs once every two rotations of the crankshaft 160. While any two consecutive rotations of crankshaft 160 is accompanied by one opening of intake valve 125 and one opening of exhaust valve 325, the openings are non-concurrent and are configured to occur at optimal moments of the 4-stroke engine cycle. This configuration of operation may be explained using FIG. 4*a*.

When crankshaft 160 rotates, the apex of cam channel 110 urges cam follower assembly 122 radially outwards at a first instance, the apex of cam channel 110 then urges cam follower assembly 322 radially outwards at a second instance. The difference in time between the first and second instances is attributable to the rotational speed of the apex of cam circle 110 and the positioning of the two cam follower assemblies along the circumference of crank web 130. The relative distance along the circumference may be set such that the two assemblies are located diagonally opposing each other, in a 180 degrees relationship. Alternatively, they may be set at angles greater than or less than 180 degrees, such angles being shown by arrows 445 and 446. These angles can be used to advance or delay the opening of exhaust valve 325 with reference to the opening of intake valve 125. Such advancing or delaying is used to modify the expansion to compression ratio of engine 100.

Figure 4B:
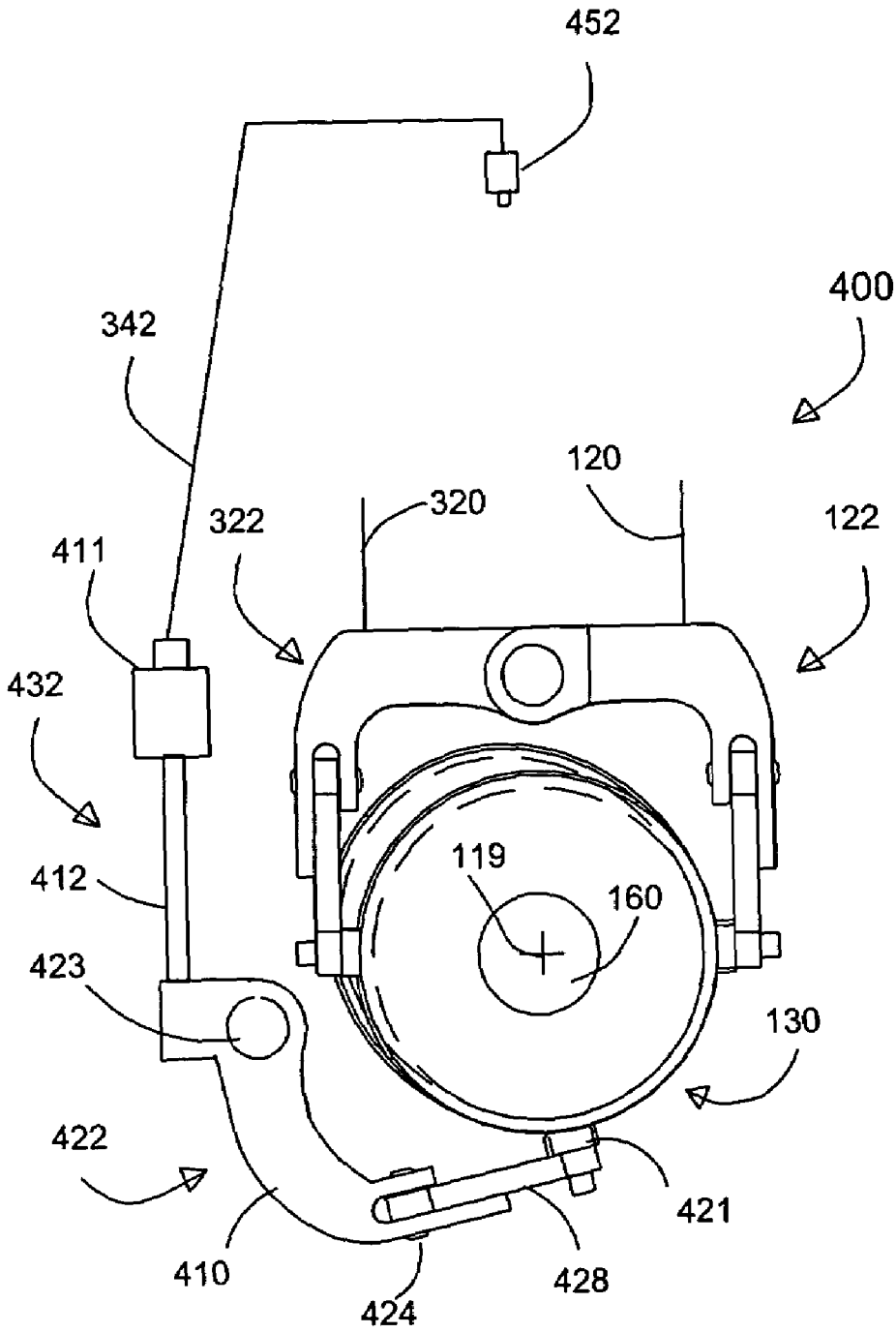
FIG. 4*b* is a perspective view of an alternative embodiment of the engine of FIG. 1, having a fuel-injection follower assembly that is incorporated into the mono-shaft engine valve operating system.

Attention is now drawn to FIG. 4*b*, which is a perspective view of an alternative embodiment of the engine of FIG. 1, and incorporates a fuel-injection follower assembly into the mono-shaft engine valve operating system. In this embodiment, a 4-stroke mono-shaft engine uses a single cam follower channel assembly to commonly operate an intake valve, an exhaust valve, and additionally, a fuel injection system.

The fuel injection system injects fuel directly into the combustion chamber (not shown) using a fuel pump assembly 432 that includes a fuel pump follower assembly 422, a fuel pump 411, a fuel line 342, and a fuel injector 452.

Fuel pump follower assembly 422 may be generally defined as comprising an L-shaped follower arm 410 that is secured at one end of the L-shape to a pivot pin 423 that is mounted at a suitable location of an engine block (not shown) and wherein the other end of the L-shape of follower arm 410 is attached to a transverse follower arm 428 that is in slideable contact with crank web 130. The slideable contact of transverse follower arm 428, which provides the pivoting action for L-shaped follower arm 410, will be explained in further detail later. The bottom end of reciprocating rod 412 is connected to the vertex of the L-shaped follower arm 410. With this configuration, reciprocating rod 412 is urged to reciprocate up and down whenever follower arm 410 pivots on pivot pin 423. The pivoting action of follower arm 410 is in correspondence to a rotation of the cam follower channel assembly that is circumferentially incorporated into crank web 130, the cam follower channel assembly providing a camming function. This camming function is similar to that described earlier with reference to cam follower assemblies 122 and 322. When reciprocating rod 412 rises as a result of the camming function, fuel pump 411 is operated and fuel is urged into fuel line 342, from where the fuel is transported to fuel injector 422 and subsequently injected into the combustion chamber.

Figure 5:
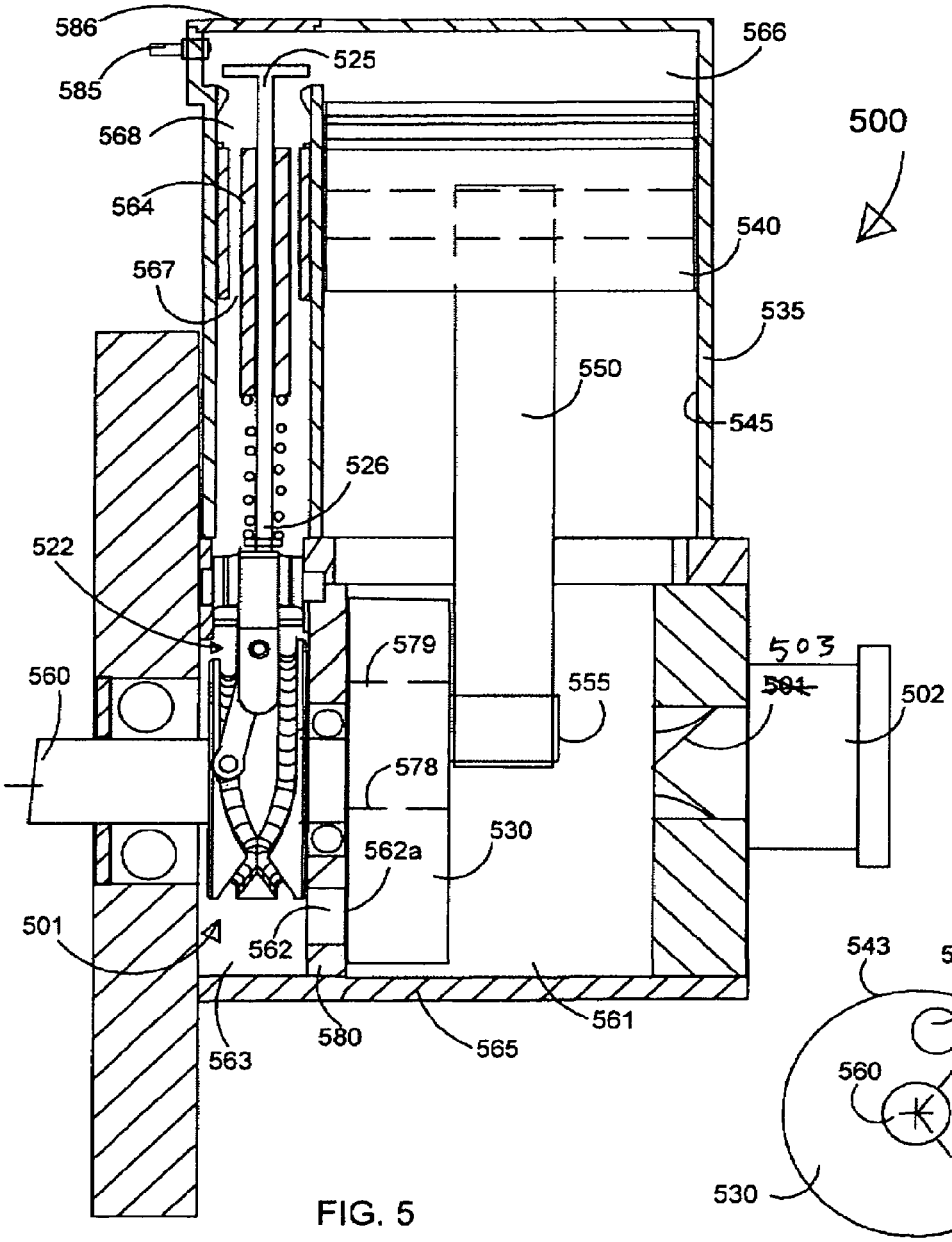
FIG. 5 is a sectional elevational view of a mist-lubricated L-head engine with the mono-shaft engine valve operating system incorporated inside a engine housing.

Attention is now drawn to FIG. 5, which illustrates an alternative embodiment of the invention, wherein the mono-shaft engine multi-valve operating system is incorporated into a mist-lubricated supercharged 4-stroke "L" head engine 500. Engine 500 includes a cylinder block 535 that houses a cylinder bore 545, intake passage system 567, inlet valve 525, and exhaust valve (not shown). A piston 540 reciprocates within the cylinder bore 544 and is connected by means of a connecting rod 550 to crank throw 555 on a circular crank web 530 of crankshaft 560. The crankshaft 560 is journaled for rotation about a crankshaft axis 599 within crankcase chamber 561 of crankcase 565 that is affixed to the lower end of the cylinder block 535 in a suitable manner. A combustion chamber 566 is defined as a region within the cylinder bore 545 above the piston 540, under cylinder head 586 and includes the region above the intake valve 525 and exhaust valve (not shown). A spark plug 585 is housed in cylinder head 586. Spark plug 585 may be replaced with a fuel injector when engine 500 is a compression engine.

Engine 500 contains two chambers—crankcase chamber 561 and valve train chamber 563 that are operatively interconnected through a passage 562 and a crankcase port 562*a*. Crankcase chamber 561 is defined by a region within crankcase 565 and includes the region defined by an internal wall 580 that separates crankcase chamber 561 from valve train chamber 563. Valve train chamber 563 is defined by a region within engine housing 535 and a region extending down into crankcase 565 adjacent to crankcase chamber 561.

Valve train chamber 563 houses an intake manifold 568 and a mono-shaft valve operating system, which is one embodiment of the mono-shaft engine multi-valve operating system. The valve operating system includes intake valve 525 comprising an elongated stem 526. The bottom end of stem 526 is mounted on to cam follower assembly 522. Cam follower assembly 522 is operatively coupled to cam follower channel assembly 501 in manner similar to that described with reference to the embodiments of FIGS. 1–4*a*.

Cam follower channel assembly 501 is mounted on crankshaft 560, and is journaled for rotation about crankshaft 560, within valve train chamber 563. Crank web 530 is mounted on crankshaft 560, adjacent to cam follower channel assembly 501, and is journaled for rotation about crankshaft 560, within crankcase chamber 561. Internal chamber wall 580 incorporates charge passage 562 that provides gaseous interaction between crankcase chamber 561 and valve train chamber 563. Charge passage 562 connects to crankcase port 562*a* that is opened/closed by a rotating valve that is incorporated into crank web 530.

Figure 6:
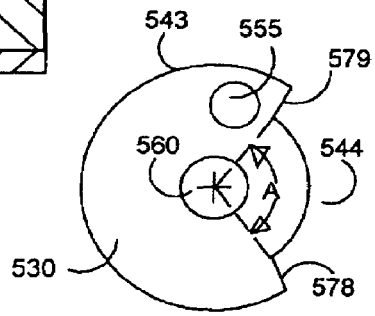
FIG. 6 is an end plan view of the crank web of the engine of FIG. 5.

Crank web 530 is shown in further detail in FIG. 6. Annular opening 544 extends through a part of radially outermost section 543 of crank web 530, and extends from one major surface to the opposing major surface of crank web 530. When crank web 530 rotates on crankshaft 599, annular opening 544 provides a rotating valve that provides flow of gas between crankcase chamber 561 and valve train chamber 563 through charge passageway 562. It will be apparent to persons of ordinary skill in the art that annular opening 544 can be located at one or several locations along the circumference or major surfaces of crank web 530, and can also be shaped in several alternative configurations such as an arc, a circle, and an oval hole. "A" between edges 578 and 579 of annular opening 544 is configured to allow interaction between crankcase chamber 561 and valve train chamber 563 for a fraction of the 360 degrees described by crank web 530.

Crankcase 565 houses a one-way valve 503 that is gaseously interconnected with a carburetor 502. One-way valve 503 operates in a manner similar to an intake valve of a conventional 2-stroke engine. A rotary valve or a piston valve similar to the type that is employed in two-stroke engines, may also be provided in place of the one-way valve 503. Fuel-air mixture is inducted through the one-way valve 503 as piston 540 moves upwards. When piston 540 moves down subsequently, annular opening 544 is aligned with charge passageway 562 thereby allowing the fuel-air mixture to flow from crankcase chamber 561 into valve train chamber 563. Upon entry into valve train chamber 563, the fuel-air mixture, together with any oil that may have been optionally added to the fuel-air mixture, travels upwards through the passages 567 around the intake valve guide 564 into the intake port 568 before entering combustion chamber 566. This fuel-air flow from crankcase chamber 561 into combustion chamber 566 constitutes a supercharging function in engine 500. During both the exhaust and the compression strokes of engine 500, annular opening 544 is not aligned with passageway 562, thereby preventing the flow of fuel-air mixture from exiting the valve train chamber 561.

In this embodiment, the induction of fuel-air mixture into the combustion chamber 566 occurs only every other rotation of crankshaft 560. In this case, as in a two-stroke engine, fuel may be mixed with lubricating oil to mist-lubricate the internal parts of engine 500. As such, a dry-sump crankcase chamber 561 allows engine 500 to be operated in various orientations. Also, since piston 540 and crankcase chamber 561 are used as a pumping system for supercharging engine 500, the mass of charge inducted into the combustion chamber 566 may be higher than in a naturally-aspirated engine of similar displacement.

The mist-lubrication with rotary valve controlled passage between the crankcase chamber 561 and the valve train chamber 563 may be applied to a conventional four-stroke engine, be it either overhead valve or a side valve engine.

Figure 7:
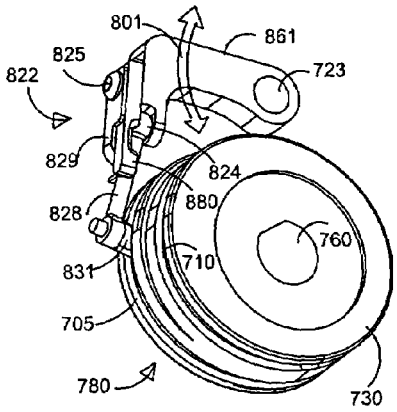
FIG. 7 is a perspective elevational view of dual cam channel follower assembly showing exhaust follower.
Figure 7A:
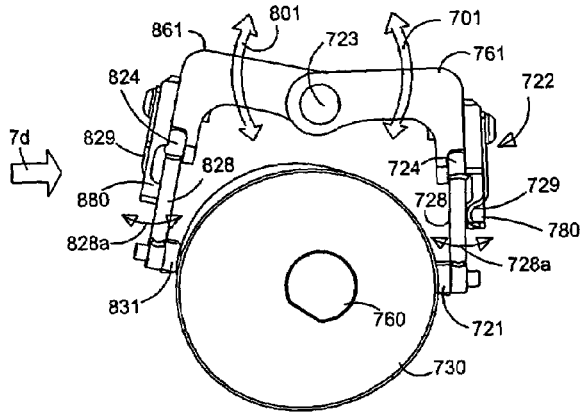
FIG. 7*a* is a profile view of the dual cam channel follower assembly with exhaust follower disposed in a exhaust cam channel, consequently configuring the exhaust valve open position.
Figure 7B:
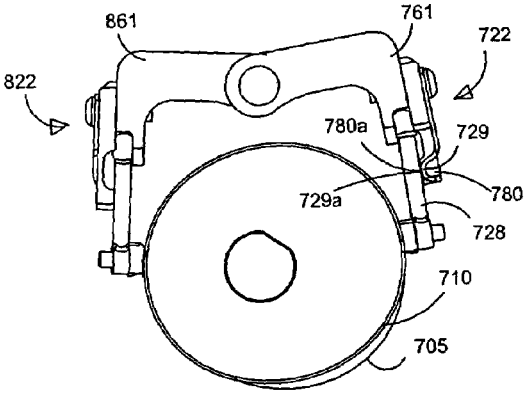
FIG. 7*b* is a profile view of the dual cam channel follower assembly with intake follower disposed in a intake cam channel, consequently configuring the intake valve open position.
Figure 7D:
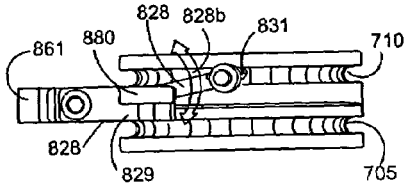
FIG. 7*d* is a profile side view 7*d* of FIG. 7*a* with the exhaust follower disposed in a exhaust cam channel.
Figure 7E:
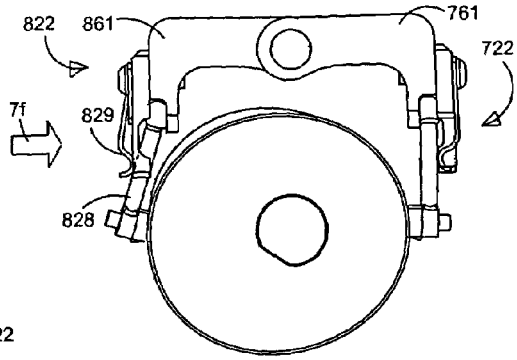
FIG. 7*e* is a profile view of the dual cam channel follower assembly with exhaust follower disposed in a intake cam channel, consequently configuring the exhaust valve closed position due to exhaust follower's lost motion.
Figure 7C:
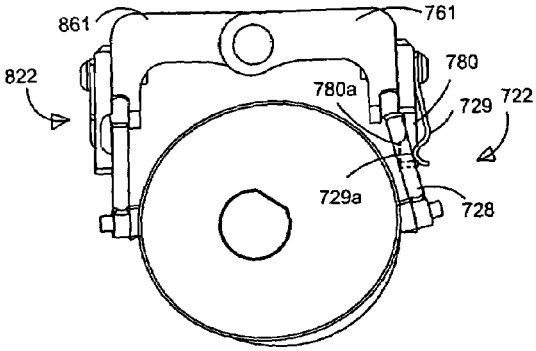
FIG. 7*c* is a profile view of the dual cam channel follower assembly with intake follower disposed in a exhaust cam channel, consequently configuring the intake valve closed position, due to intake follower's lost motion.
Figure 7F:
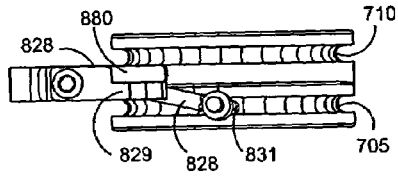
FIG. 7*f* is a profile side view 7*e* of FIG. 7*e* with the exhaust follower disposed in a intake cam channel.

FIGS. 7–7*f* detail an alternative design for intake and exhaust valve actuation by cam follower assemblies 722 and 822 and the cam follower channel assembly 780, which allows for varying cam channel profiles providing asymmetric engine timing.

It will be understood that the configuration and description of operation of cam follower assemblies 722 and 822 and cam follower channel assembly 780 is correspondingly applicable to the configuration and description of operation of cam follower assemblies 122 and 322 and cam follower channel assembly 180 described earlier with reference to FIGS. 1–4*a*, with the exception of the variation of providing individual cam channels for exhaust 710 and intake 705 and the introduction of "lost motion" in cam follower assemblies 722 and 822, to be further detailed later.

FIG. 7*a* shows an intake cam follower and an exhaust cam follower assembly 722 and 822, respectively, in their position during the initial rotation of the engine crankshaft. Cam follower assembly 722 generally follows the previous cam follower descriptions as comprising an L-shaped follower arm 761 that is secured at one end of the L-shape to a free-standing pivot pin 723, and wherein the other end of the L-shape of follower arm 761 is attached to a transverse follower arm 728 that is in slideable contact with cam channel assembly 780. The pivoting action of follower arm 761 is in correspondence to a rotation of the cam follower channel assembly 780 that provides a camming function. Pivoting direction of follower arm 761 is generally described by arrow 701 of FIG. 7*a*.

Cam follower assembly 822 may be generally defined as comprising an L-shaped follower arm 861 that is secured at one end of the L-shape to the free-standing pivot pin 723, and wherein the other end of the L-shape of follower arm 861 is attached to a transverse follower arm 828 that is in slideable contact with cam channel assembly 780. The pivoting action of follower arm 861 is in correspondence to a rotation of the cam follower channel assembly 780 that provides a camming function. This camming function will be described later. Pivoting direction of follower arm 861 is generally described by arrow 801 of FIGS. 7–7*a*.

The slideable contact of transverse follower arm 728 of cam follower assembly 722, with crank web 730 will now be explained. It will be understood that the configuration and description of operation of cam follower assembly 722 that is associated with the intake valve, is correspondingly applicable to the configuration and description of operation of cam follower assembly 822 that is associated with the exhaust valve.

In this exemplary embodiment, transverse follower arms 728 and 828 are in slideable contact with a dual, commonly-shared cam follower channel assembly 780 that is incorporated into either crank web 730 or a separate assembly 501 shown in FIG. 5. Cam follower channel assembly 780 is comprised of both an intake 705 and exhaust 710 cam channel interconnected by a crossover channel (shown as 111 in FIG. 2). Each cam channel is comprised of a unique cam profile with a common base circle diameter profile providing disparate amounts of intake or exhaust valve opening and closure, thus referred to as asymmetric timing.

The slideable contact of transverse follower arm 728 of cam follower assembly 722, with crank web 730 will now be explained using FIGS. 7*a*–7*e*. It will be understood that the configuration and description of operation of cam follower assembly 722 that is associated with the intake valve, is correspondingly applicable to the configuration and description of operation of cam follower assembly 822 that is associated with the exhaust valve.

Drawing attention to FIGS. 7*a* and 7*b* that illustrate cam follower assembly 722 in greater detail, cam follower assembly 722 comprises L-shaped follower arm 761, transverse follower arm 728, follower arm support 780, and follower 721. Transverse follower arm 728 is pivotably attached to follower arm 761 being trapped by elbow support 780, and is configured to describe a dual transverse movement that is generally described by arrow 728*a* of FIG. 7*a* and away from the plane of paper (similar to the arrow 828*b* shown in FIG. 7*d* for the follower 828). The dual transverse motion is made possible by ball joint 724. Follower 721 is mounted on transverse follower arm 728 at a distal end away from the end of transverse follower arm 728 that is comprised of ball joint 724.

During the initial rotation, follower 721 is slideably housed inside of intake cam channel 705 providing a camming action by applying radially outwards-extending pressure upon follower 721, which exerts pressure against follower arm 728, which is supported by direct contact with follower arm support 780, and thus urging cam follower assembly 722 in the direction of arrow 701 shown in FIG. 7*a*, which, as shown in FIG. 7*b*, in turn actuates the intake valve assembly.

FIG. 7*c* shows the subsequent engine crankshaft rotation, which results in the intake follower assembly 722 lost motion. The intake cam follower 721 is slideably moved through the base circle crossover channel to the exhaust cam channel 710. Follower arm 728 is thus transversely pivoted so that it is now fully supported only by follower arm spring 729 at contact point 729*a*. As the crank web 730 rotates the camming action is applied radially outwards-extending pressure upon follower 721 and follower arm 728, causing the follower arm 728 to exert force on the follower arm spring 729. Follower arm spring 729, having less spring force than the intake valve spring (shown as spring 125*a* in FIG. 1), gives way. Thus, no movement of cam follower assembly 722 occurs in direction of arrow 701 shown in FIG. 7*a*. This allows crank web 730 to rotate without actuating the intake valve (shown as 125 in FIG. 1), thus producing the lost motion.

The exhaust follower assembly 822 functions in the same manner as described for the intake follower assembly 722. However, as shown in FIGS. 7*e*–7*f*, the lost motion is produced on the initial crankshaft rotation whereby the exhaust cam follower 822 is slideably housed in the intake cam channel 705. Follower arm 828 is thus transversely pivoted so that it is now fully supported only by follower arm spring 829. As the crank web 730 rotates the camming action is applied radially outwards-extending pressure upon follower 821 and follower arm 828, causing the follower arm 828 to exert force on the follower arm spring 829. Follower arm spring 829, having less spring force than the exhaust valve spring (shown as 325*a* in FIG. 1), gives way. Thus, no movement of cam follower assembly 822 occurs in direction of arrow 801 shown in FIG. 7*a*. This allows crank web 730 to rotate without actuating the exhaust valve (shown as 325 in FIG. 1), thus producing the lost motion.

The subsequent crankshaft rotation causes the exhaust follower assembly 822 to slideably move to the exhaust cam channel 710. Follower arm 828 is thus transversely pivoted to make contact with follower arm support 880. Crank web 730 rotation thus provides a camming action by applying radially outwards-extending pressure upon follower 821, which exerts pressure against follower arm 828, which is supported by direct contact with follower arm support 880, and thus urging cam follower assembly 822 in the direction of arrow 801 shown in FIG. 7*a*, which, as shown in FIG. 7*a*, in turn actuates the exhaust valve assembly.

Figure 8:
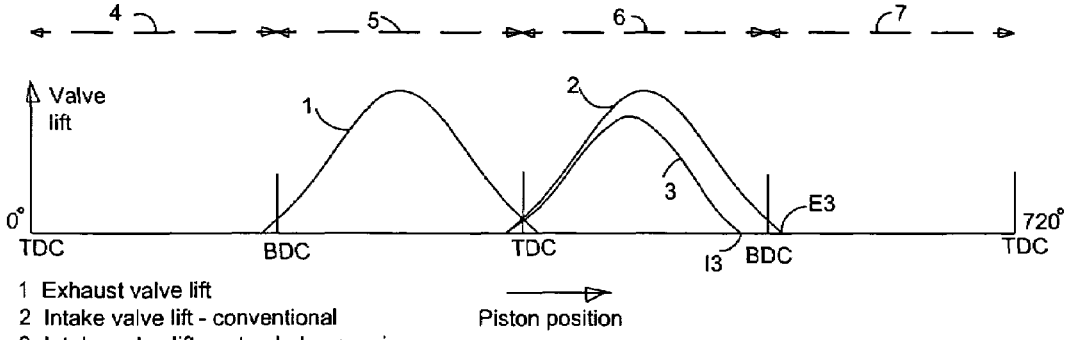
FIG. 8 is a valve lift diagram for exhaust valve, conventional intake valve and intake valve for early intake valve.
Figure 8A:
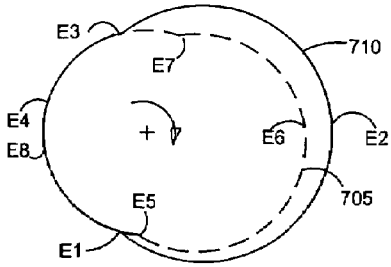
FIG. 8*a* is profile view of the cam channel assembly showing the path traced by a exhaust cam follower.
Figure 8B:
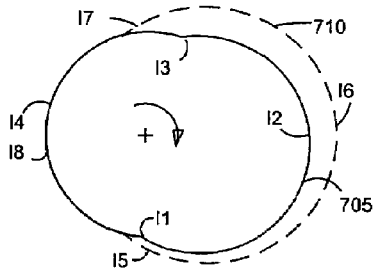
FIG. 8*b* is profile view of the cam channel assembly showing the path traced by a intake cam follower.
Figure 8C:
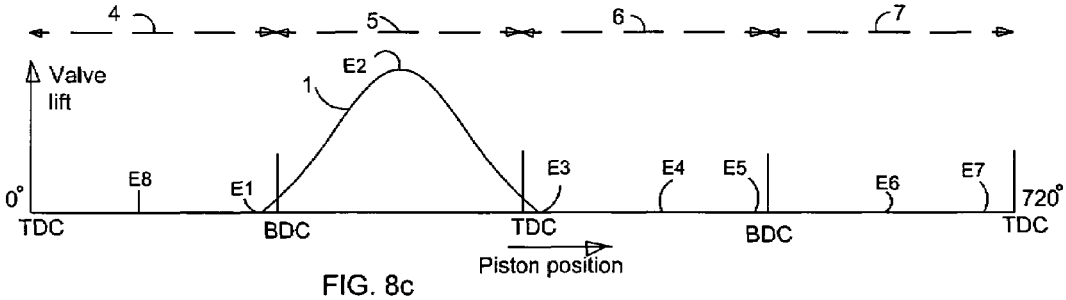
FIG. 8*c* is a exhaust valve lift versus piston position as the valve lift is generated by the cam follower tracing the path shown in FIG. 8*a*.
Figure 8D:
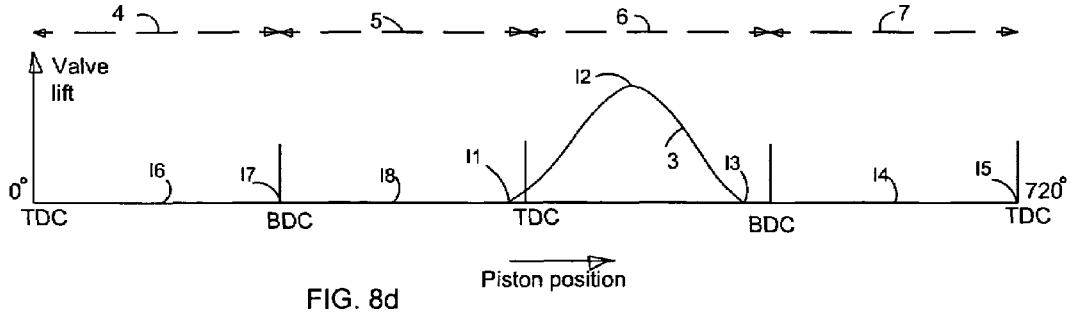
FIG. 8*d* is a intake valve lift versus piston position as the valve lift is generated by the cam follower tracing the path shown in FIG. 8*b*.

FIGS. 8–8*d* chart the details of the asymmetrically timed engine, showing valve opening and closing windows relative to piston position at Top Dead Center (TDC) and Bottom Dead Center (BDC).

FIG. 8 shows typical valve lift profiles versus piston position through 720 degrees in a four-stroke engine. The exhaust valve lift 1 occurs during the exhaust process 5 following the expansion process 4. Typically exhaust valve starts to open at E1 shown in FIGS. 8*a* and 8*c*, before the piston reaches BDC at the end of expansion process 4 and closes at E3 a few degrees after TDC. The intake valve lift occurs during the intake process 6. Typically intake valve begins to open at 11, shown in FIGS. 8, 8*b*, and 8*d*, before the piston reaches TDC at the end of exhaust process 5. In a conventional four-stroke engine, the intake valve closes a few degrees after BDC as shown as profile 2 in FIG. 8. However, the intake valve may be closed before the piston reaches BDC at 13, before the end of intake process 6, shown as valve lift profile 3 in FIGS. 8 and 8*d*.

FIG. 8*a* shows the angular and radial position of the exhaust cam follower 831 on the exhaust cam channel 710 and the intake cam channel 705. The numbers E1 through E8 in FIG. 8*a* show the sequence of contact position of the exhaust cam follower 831 as the cam channel assembly 780 rotates through 720 crank angles. The resulting exhaust valve lift profile is shown in FIG. 8*c*. As the exhaust cam follower 831 slides on the intake cam channel 705 along contact points E5–E7, the exhaust valve lift will be zero shown in FIG. 8*c*.

FIG. 8*b* shows the angular and radial position of the intake cam follower 721 on the intake cam channel 705 and the exhaust cam channel 710. The numbers I1 through I8 in FIG. 8*b* show the sequence of contact position of the intake cam follower 721 as the cam channel assembly 780 rotates through 720 crank angles. The resulting intake valve lift profile is shown in FIG. 8*d*. As the intake cam follower 721 slides on the exhaust cam channel 710 along contact points I5–I7, the intake valve lift will be zero shown in FIG. 8*d*. Zero intake valve lift and exhaust valve lift when the respective followers 721 and 831 are sliding on the exhaust cam channel 710 and intake cam channel 705, respectively, is a result of lost motion provided by the follower assemblies explained earlier with respect to FIGS. 7*a*–7*f*.

The early intake valve closing in conjunction with supercharging as described with reference to FIG. 8*d* and FIG. 5 may off-set the reduction in effective displacement volume, as the supercharging increases the breathing efficiency of the engine in comparison to a naturally aspirated engine. The longer expansion ratio in comparison to the lower effective compression ratio due to early (or late) intake valve closing results in an extended expansion engine, in the sense that the expansion ratio is higher than the effective compression ratio. The expansion ratio may also be referred to as geometric compression ratio, which is a ratio of cylinder volume at BDC to the cylinder volume at TDC.

The above-described embodiments of the present invention are merely set forth for a clear understanding of the principles of the invention. Many variations and modifications may be made without departing substantially from the invention. All such modifications and variations are included herein within the scope of this disclosure and the present invention and protected by the following claims.

We claim:

1. A 4-stroke monoshaft multi-valve internal combustion engine comprising:

a first cam follower assembly configured to operate an intake valve of the engine, a second cam follower assembly configured to operate an exhaust valve of the engine, a cam follower channel assembly comprising a base circle channel circumferentially cut in a crank web attached to a crank shaft of the engine, a cam channel circumferentially cut substantially parallel to the base circle channel, a channel crossover cut to provide channel interconnectivity between the base circle channel and the cam channel, wherein when the first cam follower assembly is slideably engaged to the cam channel the intake valve is operated during a first-half rotation of the crank web, and wherein when the second cam follower assembly is slideably engaged to the cam channel the exhaust valve is activated during a second-half rotation of the crank web, first and second L-shaped follower arms of the first and second cam follower assemblies respectively pivotally mounted to a single free standing pivot pin that is parallel to a crank axis of the crank web, first and second transverse follower arms pivotally mounted at first and second distal ends of the first and second L-shaped follower arms, first and second followers mounted on the first and second transverse follower arms respectively and disposed within the cam follower channel assembly, and the first and second L-shaped follower arms operatively connected by first and second push-tubes to the intake and exhaust valves respectively and to reciprocate and activate the intake and exhaust valves.

2. An engine as claimed in claim 1, wherein the first transverse follower arm is configured to slideably engage the cam follower channel assembly and urge the first distal end of the first L-shaped follower arm away from the crank web of the engine when the first cam follower assembly is slideably engaged to a first portion of the cam channel.

3. An engine as claimed in claim 2, wherein the second transverse follower arm is configured to slideably engage the cam follower channel assembly and urge the second distal end of the second L-shaped follower arm away from the crank web of the engine when the second cam follower assembly is slideably engaged to a second portion of the cam channel.

4. A 4-stroke monoshaft multi-valve internal combustion engine comprising:

at least one intake valve and at least one exhaust valve of the engine, a first cam follower assembly configured to operate at least one of the intake and exhaust valves of the engine, a cam follower channel assembly comprising a base circle channel circumferentially cut in a crank web of the engine, a cam channel circumferentially cut in the crank web substantially parallel to the base circle channel, a channel crossover cut in the crank web interconnecting the base circle channel and the cam channel, the first cam follower assembly being slideably engaged to the cam channel wherein the at least one of the intake and the exhaust valves is activated during a first-half rotation of the crank web, and a fuel injection follower assembly configured to operate a fuel injection system of the engine and wherein when the fuel injection follower assembly is slideably engaged to the cam channel of the cam follower channel assembly such that the fuel injection system of the engine is activated during a second-half rotation of the crank web.

5. A 4-stroke monoshaft multi-valve internal combustion engine comprising:

at least one intake valve and at least one exhaust valve of the engine, a first cam follower assembly configured to operate at least one of the intake and exhaust valves of the engine, a cam follower channel assembly comprising a base circle channel circumferentially cut in a crank web of the engine, a cam channel circumferentially cut in the crank web substantially parallel to the base circle channel, a channel crossover cut in the crank web interconnecting the base circle channel and the cam channel, the first cam follower assembly being slideably engaged to the cam channel wherein the at least one of the intake and the exhaust valves is activated during a first-half rotation of the crank web, and a crank shaft to which the crank web and a rotatable valve are attached and at least one opening in the rotatable valve alignable with a charge passage extending between a crank case chamber and a combustion chamber of the engine.

6. A 4-stroke monoshaft multi-valve internal combustion engine comprising:

a cylinder block housing a cylinder bore, a piston reciprocably disposed within the cylinder bore and connected by means of a connecting rod to a crank throw on a circular crank web of a crank shaft, the crank shaft being journaled for rotation about a crank shaft axis within a crank case chamber of a crank case affixed to a lower end of the cylinder block, a combustion chamber defined as a region within the cylinder bore between the piston and a cylinder head of the cylinder block and above intake and exhaust valves, a valve train chamber including a region within an engine housing extending between the cylinder head and the crank case, the valve train chamber operatively interconnected with the crank case chamber through a charge passage in an internal wall separating the crank case chamber from the valve train chamber, the valve train chamber housing an intake manifold and a mono-shaft valve operating system, the mono-shaft engine multi-valve operating system including an intake valve having an elongated stem, a bottom end of the stem mounted to a cam follower assembly, a cam follower channel assembly comprising a base circle channel circumferentially cut in a crank web attached to a crank shaft of the engine, a cam channel circumferentially cut substantially parallel to the base circle channel, a channel crossover cut to provide channel interconnectivity between the base circle channel and the cam channel, the cam follower assembly slideably engaged to the cam channel wherein the intake valve is operated during a first-half rotation of the crank web, and a rotatable valve attached to a crank shaft and having at least one opening alignable with the charge passage.

7. An engine as claimed in claim 6, further comprising the opening being a sector having an included angle that is a fraction of a 360 degree arc length of the crank web.

8. An engine as claimed in claim 6, further comprising the rotatable valve incorporated into the crank web.

9. An engine as claimed in claim 8, further comprising the opening being a sector having an arc length that is a fraction of a 360 degree arc length of the crank web.

10. An engine as claimed in claim 6, further comprising the crank case housing a one-way valve gaseously interconnected with a carburetor.

11. An engine as claimed in claim 6, further comprising the crank case housing a rotary valve or a piston valve gaseously interconnected with a carburetor.

12. An engine as claimed in claim 11 further comprising:

first and second L-shaped follower arms of the first and second cam follower assemblies respectively pivotally mounted to a single free standing pivot pin that is parallel to a crank axis of the crank web, first and second transverse follower arms pivotally mounted at first and second distal ends of the first and second L-shaped follower arms by first and second ball joints respectively, first and second followers mounted on the first and second transverse follower arms respectively and disposed within the cam follower channel assembly, and the first and second L-shaped follower arms are operatively connected by first and second push-tubes to the intake and exhaust valves respectively and to reciprocate and activate the intake and exhaust valves.

13. A 4-stroke monoshaft multi-valve internal combustion engine comprising:

a cylinder block housing a cylinder bore, a piston reciprocably disposed within the cylinder bore and connected by means of a connecting rod to a crank throw on a circular crank web of a crank shaft, the crank shaft being journaled for rotation about a crank shaft axis within a crank case chamber of a crank case affixed to a lower end of the cylinder block, a combustion chamber defined as a region within the cylinder bore between the piston and a cylinder head of the cylinder block and above intake and exhaust valves, a valve train chamber including a region within an engine housing extending between the cylinder head and the crank case, the valve train chamber operatively interconnected with the crank case chamber through a charge passage in an internal wall separating the crank case chamber from the valve train chamber, the valve train chamber housing an intake manifold and a mono-shaft valve operating system, the mono-shaft engine multi-valve operating system including an intake valve having an elongated stem, a bottom end of the stem mounted to a cam follower assembly, a cam follower channel assembly comprising a base circle channel circumferentially cut in a crank web attached to a crank shaft of the engine, a cam channel circumferentially cut substantially parallel to the base circle channel, a channel crossover cut to provide channel interconnectivity between the base circle channel and the cam channel, the cam follower assembly slideably engaged to the cam channel wherein the intake valve is operated during a first-half rotation of the crank web, first and second L-shaped follower arms of the first and second cam follower assemblies respectively pivotally mounted to a single free standing pivot pin that is parallel to a crank axis of the crank web, first and second transverse follower arms pivotally mounted at first and second distal ends of the first and second L-shaped follower arms by first and second ball joints respectively, first and second followers mounted on the first and second transverse follower arms respectively and disposed within the cam follower channel assembly, and the first and second L-shaped follower arms are operatively connected by first and second push-tubes to the intake and exhaust valves respectively and to reciprocate and activate the intake and exhaust valves.

14. An engine as claimed in claim 13, further comprising first and second follower arm springs mounted to the first and second L-shaped follower arms and biasingly engaging first and second transverse follower arms.

15. An engine as claimed in claim 14, further comprising intake and exhaust valve springs operatively connected to the intake and exhaust valves in biasing opposition to the first and second push-tubes and wherein the first and second follower arm springs having less spring force than the intake and exhaust valve springs respectively.

16. An engine as claimed in claim 15, further comprising a rotatable valve attached to a crank shaft and having at least one opening alignable with the charge passage.

17. An engine as claimed in claim 16, further comprising the opening being a sector having an included angle that is a fraction of a 360 degree arc length of the crank web.

18. An engine as claimed in claim 17, further comprising the crank case housing a rotary valve or a piston valve gaseously interconnected with a carburetor.

19. An engine as claimed in claim 17, further comprising the crank case housing a one-way valve gaseously interconnected with a carburetor.

20. A 4-stroke monoshaft multi-valve internal combustion engine comprising:

an intake cam follower assembly configured to operate an intake valve of the engine, an exhaust cam follower assembly configured to operate an exhaust valve of the engine, a cam channel assembly including intake and exhaust cam channels circumferentially cut in a crank web attached to a crank shaft of the engine, a crossover channel circumferentially cut into the crank web and interconnecting the intake and exhaust cam channels, the intake and exhaust cam follower assemblies slideably engaged to the intake and exhaust cam channels respectively, the intake and exhaust cam channels having two different intake and exhaust cam profiles to provide disparate amounts of intake and exhaust valve openings and closures, first and second L-shaped follower arms of the first and second cam follower assemblies respectively pivotally mounted to a single free standing pivot pin that is parallel to a crank axis of the crank web, first and second transverse follower arms pivotally mounted at first and second distal ends of the first and second L-shaped follower arms by first and second ball joints respectively, first and second followers mounted on the first and second transverse follower arms respectively and disposed within the cam follower channel assembly, and the first and second L-shaped follower arms are operatively connected by first and second push-tubes to the intake and exhaust valves respectively and to reciprocate and activate the intake and exhaust valves.

21. An engine as claimed in claim 20, further comprising first and second follower arm springs mounted to the first and second L-shaped follower arms and biasingly engaging first and second transverse follower arms.

22. An engine as claimed in claim 21, further comprising intake and exhaust valve springs operatively connected to the intake and exhaust valves in biasing opposition to the first and second push-tubes and wherein the first and second follower arm springs having less spring force than the intake and exhaust valve springs respectively.

23. An engine as claimed in claim 22, further comprising a rotatable valve attached to a crank shaft and having at least one opening alignable with the charge passage.

24. An engine as claimed in claim 23, further comprising the opening being a sector having an included angle that is a fraction of a 360 degree arc length of the crank web.

25. An engine as claimed in claim 24, further comprising the crank case housing a rotary valve or a piston valve gaseously interconnected with a carburetor.

26. An engine as claimed in claim 25, further comprising the crank case housing a one-way valve gaseously interconnected with a carburetor.

* * * * *